US011239603B2

(12) United States Patent
Spahic

(10) Patent No.: US 11,239,603 B2
(45) Date of Patent: Feb. 1, 2022

(54) SMOOTH-BORE ELECTRICAL CONDUIT LOCKING NUT WITH ROUNDED RIM TO AVOID WIRE INSULATION DAMAGE

(71) Applicant: R&D HOLDINGS, INC., Palatine, IL (US)

(72) Inventor: Rifet Spahic, Palatine, IL (US)

(73) Assignee: KIST CORP., Palatine, IL (US)

( * ) Notice: Subject to any disclaimer, the term of this patent is extended or adjusted under 35 U.S.C. 154(b) by 0 days.

(21) Appl. No.: 15/891,358

(22) Filed: Feb. 7, 2018

(65) Prior Publication Data

US 2020/0176926 A1 Jun. 4, 2020

Related U.S. Application Data

(60) Provisional application No. 62/431,422, filed on Dec. 7, 2016.

(51) Int. Cl.
*H01R 13/622* (2006.01)
*H01R 13/621* (2006.01)

(52) U.S. Cl.
CPC ..... *H01R 13/622* (2013.01); *H01R 13/621* (2013.01)

(58) Field of Classification Search
CPC .. H01R 13/622; H01R 13/621; H01R 13/639; H01R 4/301
USPC ..... 439/339, 321
See application file for complete search history.

(56) References Cited

U.S. PATENT DOCUMENTS 3,671,922 A * 6/1972 Zerlin ..... H01R 9/0518 439/352
7,014,406 B2 * 3/2006 Robertson ..... F16B 35/065 411/161
7,868,252 B2 * 1/2011 Spahic ..... H02G 3/065 174/84 R
8,777,538 B2 * 7/2014 Strizki ..... F16B 33/004 411/371.1
9,705,256 B1 * 7/2017 Smith ..... H01R 4/26

* cited by examiner

*Primary Examiner* — Travis S Chambers
(74) *Attorney, Agent, or Firm* — Juneau & Mitchell; Todd L. Juneau

(57) ABSTRACT

The invention relates to an electrical connector locking hub nut that does not damage the wiring during pulling, frees up manpower by allowing one person rather than two to be able to do the pulling, has a simplified design, and which has universal threading for conduit of all currently approved sizes and materials.

7 Claims, 9 Drawing Sheets

LUG holes version shown

NO-LUG holes version shown

Version I - “threadless”

SMOOTH-BORE ELECTRICAL CONDUIT LOCKING NUT WITH ROUNDED RIM TO AVOID WIRE INSULATION DAMAGE

BACKGROUND

Field of the Invention

This invention relates to improved electrical fittings used in the installation of electrical conduit, and namely an improved electrical conduit lock nut or locking hub nut.

Background of the Invention

The current state of knowledge is as follows. Electrical conduit is a system used for protection and routing of electrical wiring. Electrical conduit is generally made of metal or plastic polymers, and protects the wiring from mechanical damage and chemical interference, e.g. water. Conduit also requires the use of special fittings for connections, end points, and so forth. Two common electrical connectors are snap-in connectors and multi-part connectors. Snap-in connectors use a snap-in ring to quickly connect to a junction box, and multipart connectors use threaded, multipart lock-nut components. Various types of wiring can be pulled into a conduit, which simplifies building design and construction as well as building renovations, since wiring can be added or replaced by pulling through the existing conduit.

However, wiring is frequently damaged during such pulls due to the interaction of the wiring on the fittings that are used, often resulting in the wiring insulation being damaged and/or removed from sections. Since the use and installation details for conduit are governed by various building codes, this kind of damage can make the difference between a successful inspection or an inspection that requires re-installation.

One way to reduce the incidence of damaging the wiring is to install the wiring in two person teams with one person feeding the wire while the other pulls it through the conduit. However, this doubles the labor cost both in terms of actual expenses as well as efficiency.

Another solution has been to use a plastic bushing to cover the sharp edges that might damage the wiring. Plastic bushings are intended to protect already installed wire during hot/cold expansion or mechanical movement. However, and although the plastic bushings are helpful for already installed wire, they are nonetheless sharp enough to damage wire during pulling and are not designed for this.

Significant problems also arise with the fittings. For instance, snap-in electrical connectors are known to be problematic for having a loose electrical connection, which can be dangerous, and they allow contaminants to enter the connection. Multipart connectors are known to be problematic for many reasons, including the inherent clumsiness of the required disassembly and reassembly, use of special tools for tightening, the potential of lost locknuts, cross-threading of the locknuts, the large amount of space used within the junction box, and the non-optional destruction of the connector that occurs during disassembly.

There remains a need for a locking hub nut that does not damage the wiring during pulling, frees up manpower by allowing one person rather than two to be able to do the pulling, has a simplified design, and which has universal threading for conduit of all currently approved sizes and materials.

BRIEF SUMMARY OF THE INVENTION

Accordingly, provided herein in order to address problems in the prior art is an electrical connector for terminating an electrical conduit having a protective rounded rim to avoid wire insulation damage, comprising: a locking hub nut, wherein said locking hub nut is toroid-shaped and has a rounded end and a flat end, said locking hub nut having a central axial bore extending therethrough, said locking hub nut having an external surface having a plurality of ribs for cooperative engagement during conduit installation, wherein central axial bore is screw-threaded along an inner surface, wherein the rounded end has a rounded rim, said rounded rim having a substantially smooth surface and extending inwardly into the central axial bore, wherein upon threading wiring through the central axial bore the rounded rim guides the wiring travelling therethrough in such a manner that there is minimal interaction with any sharp edges while being pulled through a length of conduit and interacting with the locking hub nut during such a pull operation, and wherein the locking hub nut has a height from flat end to rounded end of from about 11 mm to about 16 mm and provides for engagement with a junction box without using a lock nut.

In a preferred embodiment, the electrical connector further comprises wherein flat end has gripping projections that allow the locking hub nut to engage with the junction box and increase the frictional interaction to substantially prevent unwanted rotation.

In a preferred embodiment, the electrical connector further comprises wherein the locking hub nut has a central axial bore that is sized to engage with conduit of a specific diameters, said conduit diameter selected from a group of standard conduit sizes comprising ½", ¾", 1", 1¼", 1½", 2", 2½", 3", 3½", 4", 5", and 6".

In a preferred embodiment, the electrical connector further comprises wherein the locking hub nut has a central axial bore sized to engage conduit of a diameter comprising ½", ¾", or 1".

In a preferred embodiment, the electrical connector further comprises wherein the external surface has a plurality of screw lugs, wherein said screw lugs function as a conduit engagement system with one or more setscrews inserted into a through-hole of said screw lugs, and wherein said conduit engagement system provides a mechanism for securing conduit into position.

In a preferred embodiment, the electrical connector further comprises wherein the flat end has gripping projections that allow the locking hub nut to engage with the junction box and increase the frictional interaction to substantially prevent unwanted rotation.

In a preferred embodiment, the electrical connector further comprises wherein the locking hub nut is manufactured from galvanized steel or die-cast zinc.

BRIEF DESCRIPTION OF THE DRAWINGS

The invention will be further explained with reference to the appended Figures, wherein like structure is referred to by like numerals through the several views.

DETAILED DESCRIPTION OF THE INVENTION

Figure 1:
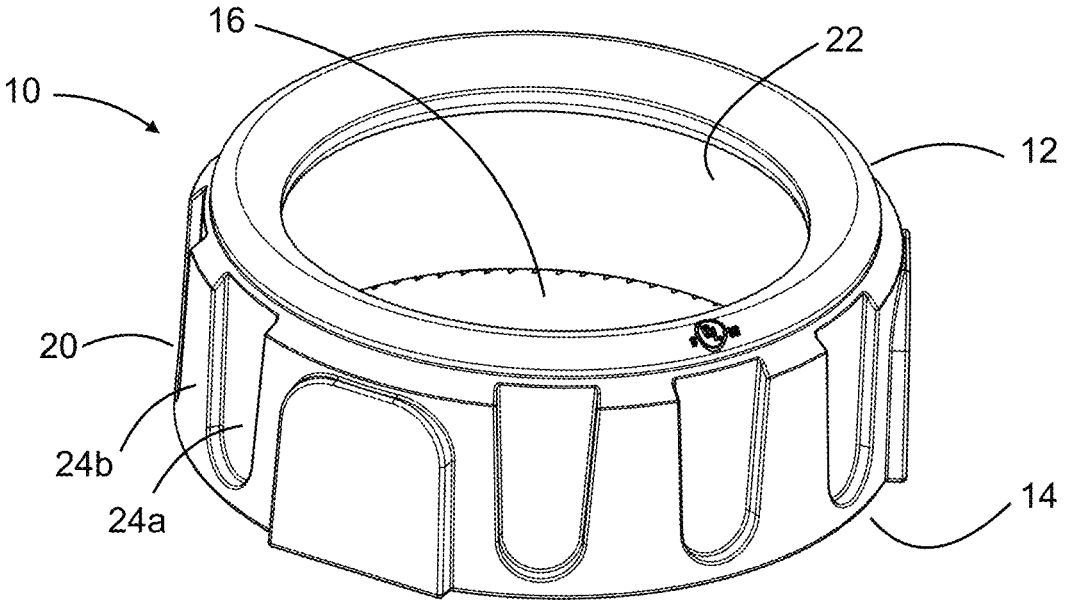
FIG. 1 shows a perspective view of one embodiment of the inventive electrical conduit lock nut.

Following are more detailed descriptions of various related concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

Referring now to the figures, locking hub nut 10 is a toroid-shaped unit having a rounded end 12 and flat end 14. Rounded end has a rounded rim 12*a* which is substantially smooth and functions to guide conduit wiring (not shown) away from damaging sharp edges and substantially prevents damage to the wire insulation. Locking hub nut 10 has an internal central bore 16 which is concentric with axis 18, and an external surface 20 having a plurality of inset panels which permits engagement by a suitable installation tool for tightening. Internal central bore 16 may be smooth or may be screw-threaded along the inner surface 22. External surface 20 is composed of a plurality of inset panels in an alternating arrangement with multiple lug panels. The inset panels may have any geometric configuration that permits grasping or attachment by hand or tool. In a non-limiting example, the external surface has a plurality of inverted parabolic inset panels or window-slots defining a series of columnar supports around the periphery of the sidewall of the locking hub nut. The column support or ribs 24 allow for engagement by a common channel lock pliers (not shown), rather than requiring any special tightening tool or risking damage to the screw-driver which is commonly used by electricians to tighten such nuts. Columns 24, without limitation, are here composed of recess 24*a* and projection 24*b*.

The rounded end 12 is the portion of the locking hub nut 10 that interacts with the wire (not shown) being pulled through the conduit and provides a smooth surface so as not to damage, or rip, the insulation that covers electrical wires. In operation, rounded rim 12*a* extends inwardly into the topmost space of the central bore 16 such that when the unit (nut 10) is viewed from directly above and looking through the bore 16, the rounded rim or rounded lip (12*a*) can be seen to guide a wire travelling therethrough in such a manner that there is little or no interaction with the threaded sidewalls nor with any edged or sharp or otherwise damaging surface that a wire might encounter while be pulled through a length of conduit and interacting with the locking hub nut during such a pull operation.

The rounded top of the side wall is composed of, starting from the outer surface of the sidewall, e.g. outside to inside, a neck region leading to a vertical surface that continues over a dome region that extends along a smooth pull surface. The pull surface curves around a rounded circular area defining a horizontal overhead section that leads to the inner surface of the sidewall. This rounded structure provides a beaded or domed rim for the top of the sidewall of the locking hub nut.

Flat end 14 may be outfitted with gripping projections 26 (shown in FIG. 2) such as a plurality of teeth, knobs, knurling, checkering, texturing, or surface features that allow the locking hub nut to engage with the junction box and increase the frictional interaction to substantially prevent unwanted rotation.

The internal central bore 16 may be smooth or may be screw-threaded for universal engagement with current types of conduit and connectors. Importantly, the unit is constructed with enough threads such that it is tall enough to eliminate the need for a traditional lock nut, thus simplifying the installation and reducing the number of parts required for installing conduit. Since most junction boxes are 3/16" thick, the locking hub nut 10 provided herein fits over existing connectors and provides a flush fit, with no edge. In preferred embodiments, the unit ranges in height from: about 11 mm to about 16 mm, and from about 12 mm to about 15 mm, and from about 12.5 mm to about 13.5 mm, and from about 12.8 mm to about 13.2 mm, and also includes without limitation each independent value therebetween. In preferred embodiments, the locking nuts are sized to fit conduit having the following standard (inner bore) dimensions (inches): ½", ¾", 1", 1¼", 1½", 2", 2½", 3", 3½", and 4".

In one preferred embodiment, the threading 22 has a 1.8 pitch, but which can be varied according to the need.

The locking hub nut 10 is manufactured to accommodate conduit of many bore diameters, including all standard sizes such as ½", ¾", 1", 1¼", 1½", 2", 2½", 3", 3½", 4", 5", and 6". In one of the preferred embodiment, the locking hub nut 10 is capable of engageably threading onto conduit of diameter ½", or ¾", or 1".

Referring now to the drawings, preferred embodiments of the locking hub nut 10 is shown.

FIG. 1 shows a perspective view of one embodiment of the inventive electrical conduit lock nut. FIG. 1 shows 3 inset panels in between each of three lug panels. FIG. 1 shows a smooth bore.

Figure 2:
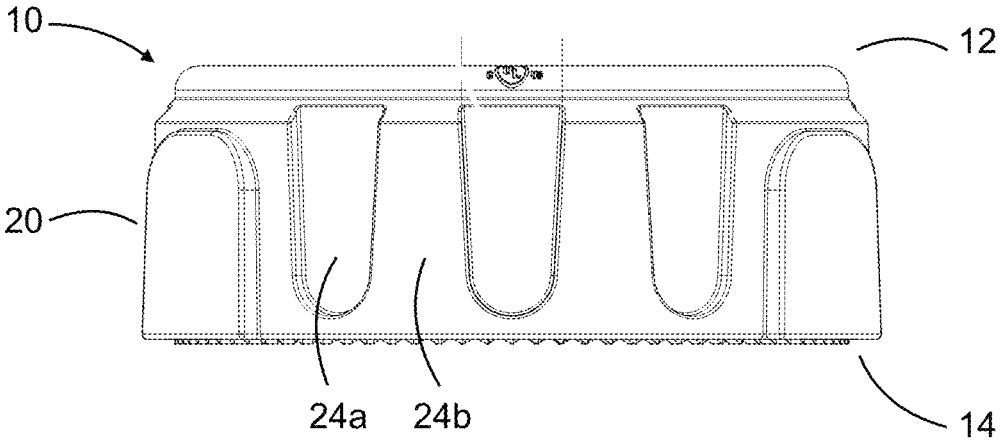
FIG. 2 is a plan or side view of one embodiment of the inventive electrical conduit lock nut.

FIG. 2 is a plan or side view of one embodiment of the inventive electrical conduit lock nut. FIG. 2 shows the teeth located on the bottom of the locking nut for tightening down the nut.

Figure 3:
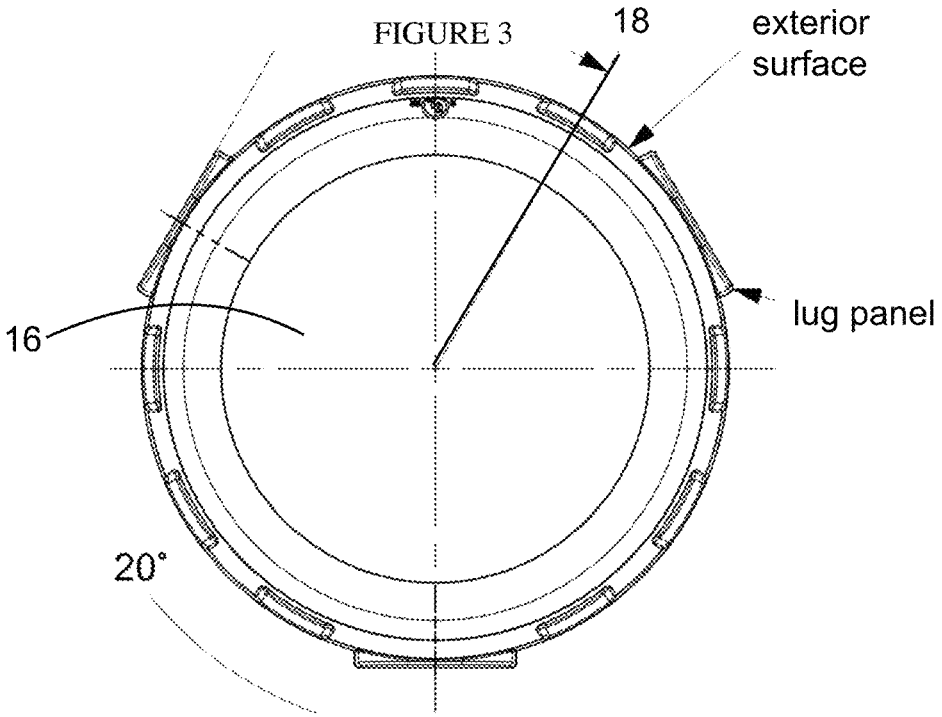
FIG. 3 is a top view of one embodiment of the inventive electrical conduit lock nut.

FIG. 3 is a top view of one embodiment of the inventive electrical conduit lock nut.

Figure 4:
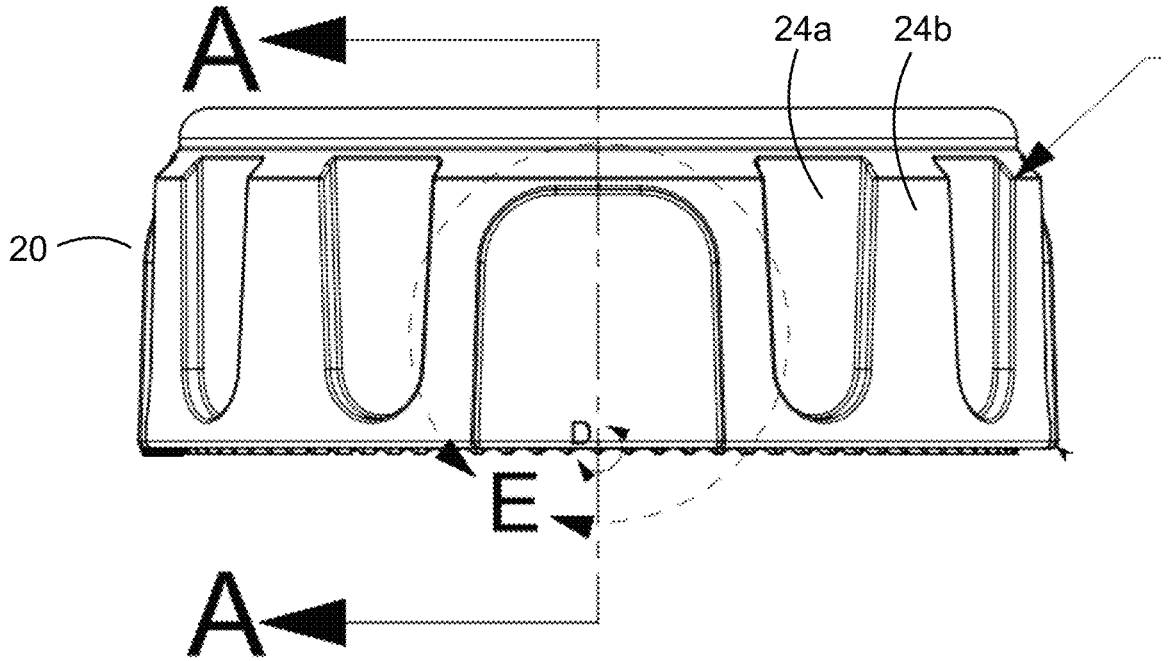
FIG. 4 is a plan or side view of one embodiment of the inventive electrical conduit lock nut.

FIG. 4 is a plan or side view of one embodiment of the inventive electrical conduit lock nut. FIG. 4 provides cross-sectional line A-A through a lug panel.

Figure 5:
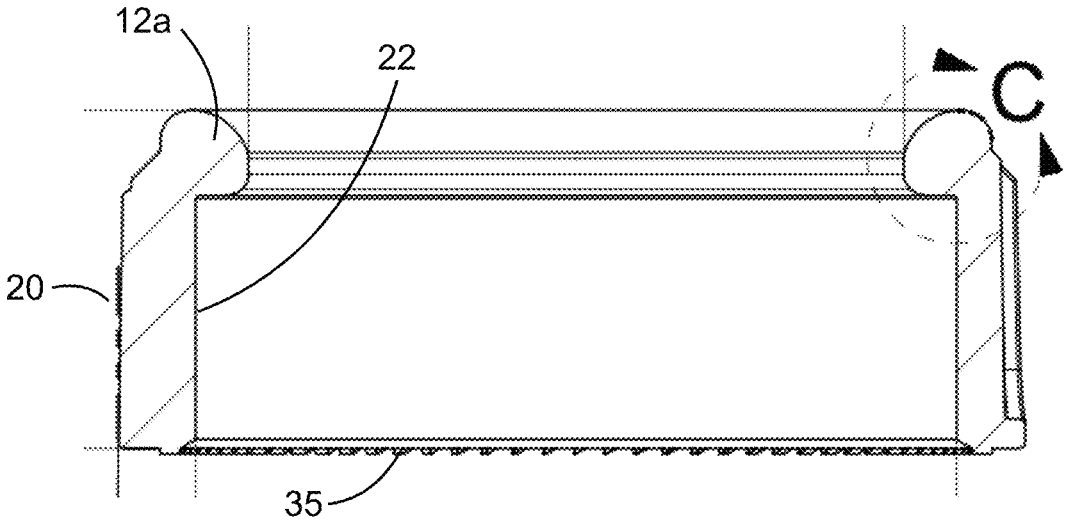
FIG. 5 is a cross-sectional view along A-A of one embodiment of the inventive electrical conduit lock nut.

FIG. 5 is a cross-sectional view along A-A of one embodiment of the inventive electrical conduit lock nut. The rounded pull surface is seen here as are the gripping teeth features. The gripping projections 34, and may include a plurality of teeth, knobs, knurling, checkering, texturing, or surface features that allow the locking hub nut to engage with the junction box and increase the frictional interaction to substantially prevent unwanted rotation.

Figure 6:
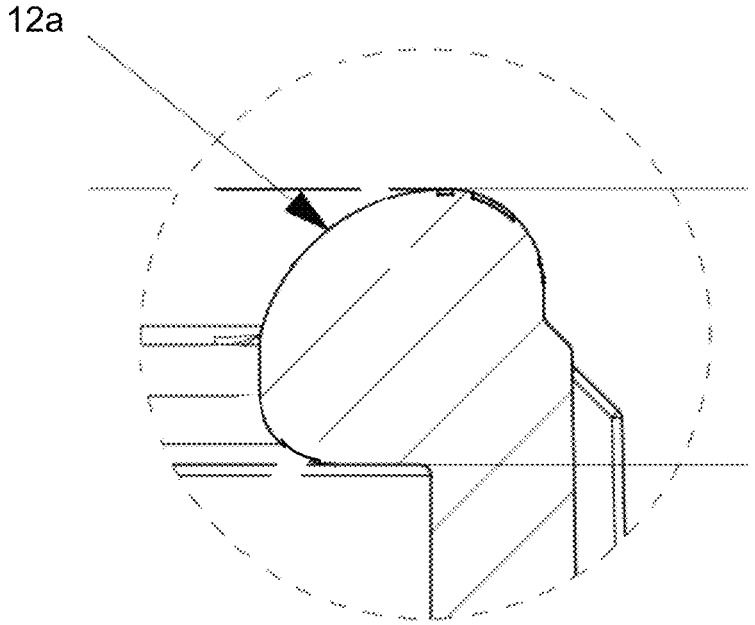
FIG. 6 is a close-up detail view of the rounded pull surface and shoulder of the rounded rim of one embodiment of the inventive electrical conduit lock nut.

FIG. 6 is a close-up detail view of the rounded pull surface and shoulder of the rounded rim of one embodiment of the inventive electrical conduit lock nut. FIG. 6 illustrates that the rounded top of the side wall is composed of, starting from the outer surface of the sidewall, e.g. outside to inside, a neck region leading to a vertical surface that continues over a dome region that extends along a smooth pull surface. The pull surface curves around a rounded circular area defining a horizontal overhead section that leads to the inner surface of the sidewall. This rounded structure provides a beaded or domed rim for the top of the sidewall of the locking hub nut.

Figure 7:
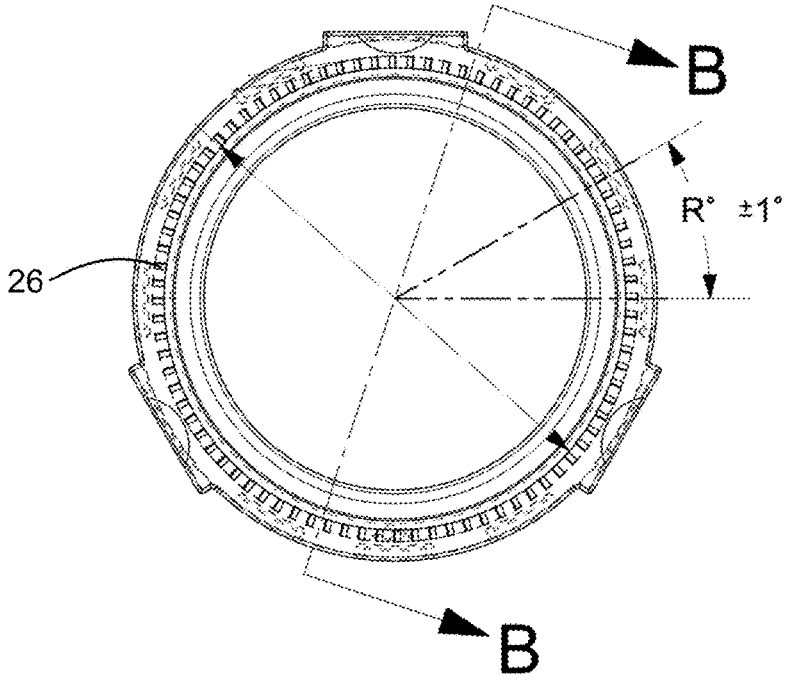
FIG. 7 is a bottom view of one embodiment of the inventive electrical conduit lock nut.

FIG. 7 is a bottom view of one embodiment of the inventive electrical conduit lock nut and shows the gripping teeth feature along the inner edge of the side wall. FIG. 7 provides Section line B-B through inset panels, not lug panels.

Figure 8:
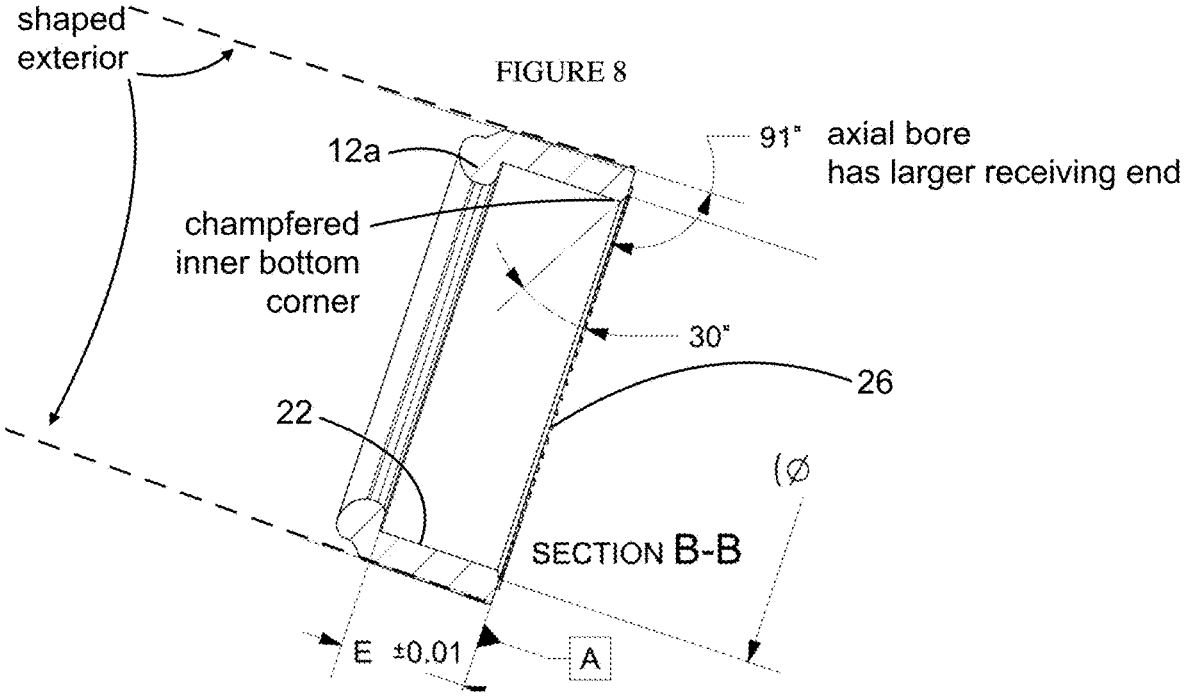
FIG. 8 is a cross-sectional view along B-B of one embodiment of the inventive electrical conduit lock nut.

FIG. 8 is a cross-sectional view along B-B of one embodiment of the inventive electrical conduit lock nut.

Figure 9:
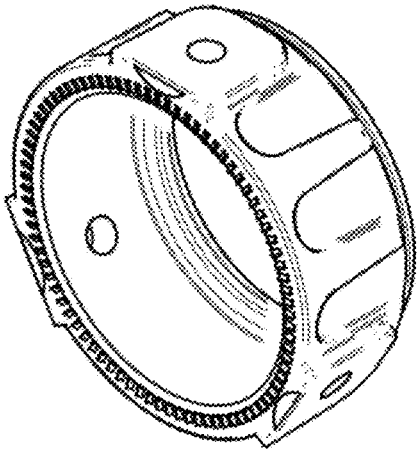
FIG. 9 is a perspective view of one embodiment of the inventive electrical conduit lock nut with lug holes.

FIG. 9 is a perspective view of one embodiment of the inventive electrical conduit lock nut with lug holes.

Figure 10:
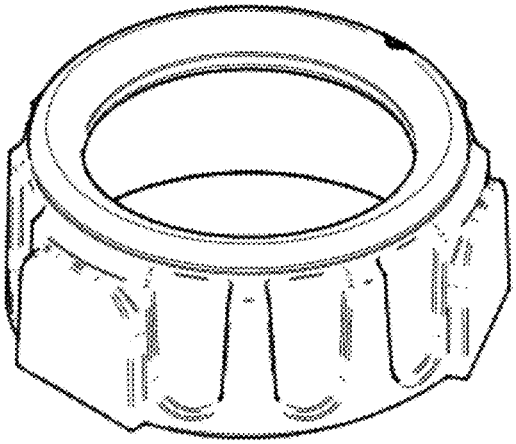
FIG. 10 is a perspective view of one embodiment of the inventive electrical conduit lock nut without lug holes.

FIG. 10 is a perspective view of one embodiment of the inventive electrical conduit lock nut without lug holes.

Figure 11:
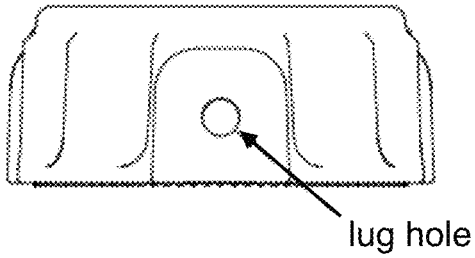
FIG. 11 is a side view of a cast embodiment of the inventive electrical conduit lock nut.

FIG. 11 is a side view of a cast embodiment of the inventive electrical conduit lock nut.

Figure 12:
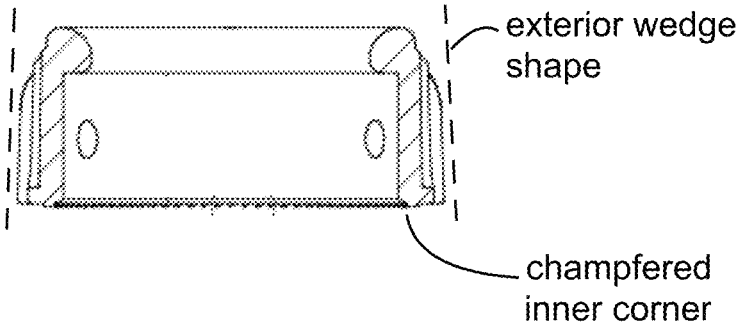
FIG. 12 is a cross-sectional view of a cast embodiment of the inventive electrical conduit lock nut.

FIG. 12 is a cross-sectional view of a cast embodiment of the inventive electrical conduit lock nut.

Figure 13:
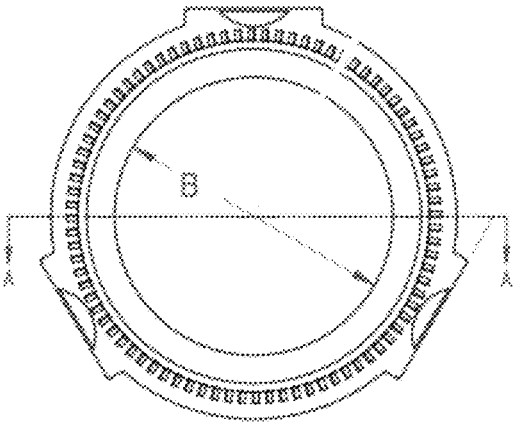
FIG. 13 is a bottom view of a cast embodiment of the inventive electrical conduit lock nut.

FIG. 13 is a bottom view of a cast embodiment of the inventive electrical conduit lock nut.

Figure 14:
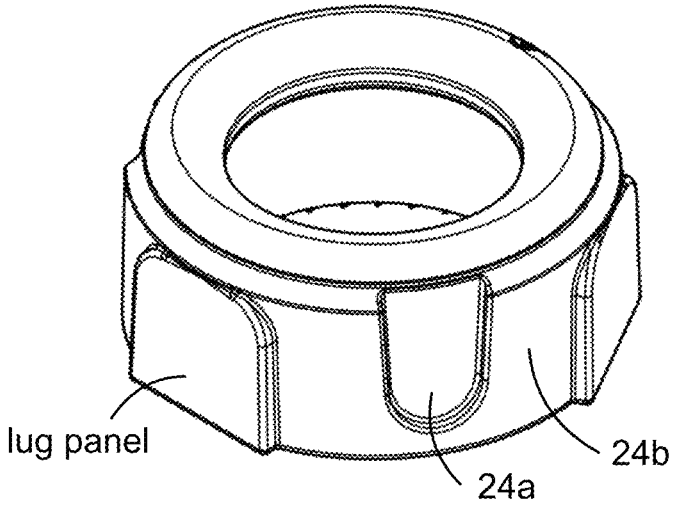
FIG. 14 is a perspective view one embodiment of the inventive electrical conduit lock nut having three inset panels alternating around the periphery of the sidewall with three lug panels.

FIG. 14 is a perspective view one embodiment of the inventive electrical conduit lock nut having three inset panels alternating around the periphery of the sidewall with three lug panels.

Figure 15:
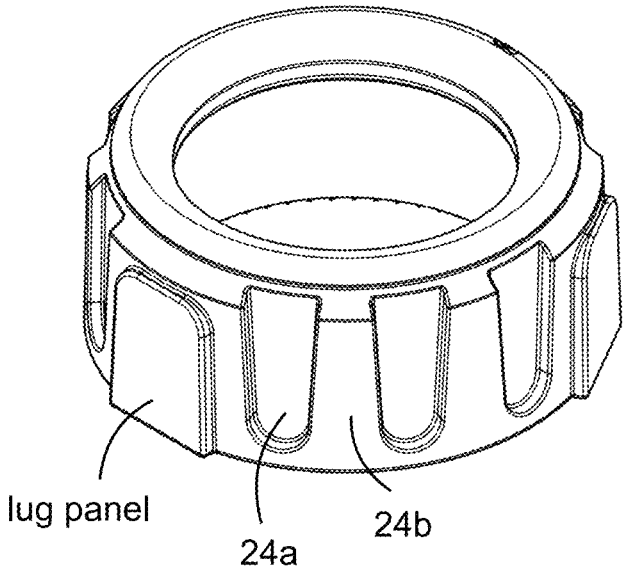
FIG. 15 is a perspective view one embodiment of the inventive electrical conduit lock nut having nine inset panels as three groups of three alternating around the periphery of the sidewall between the lug panels.

FIG. 15 is a perspective view one embodiment of the inventive electrical conduit lock nut having nine inset panels as three groups of three alternating around the periphery of the sidewall between the lug panels.

Figure 16:
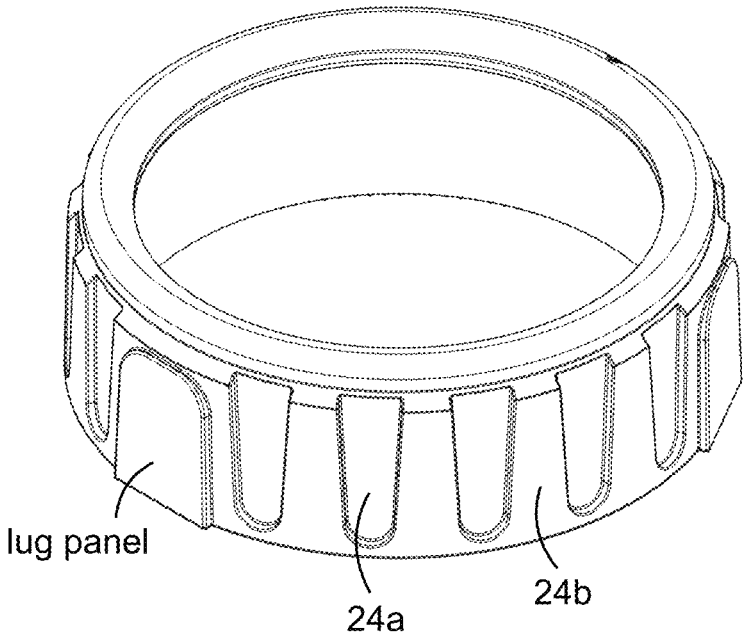
FIG. 16 is a perspective view one embodiment of the inventive electrical conduit lock nut having fifteen inset panels as three groups of five alternating around the periphery of the sidewall between the lug panels.

FIG. 16 is a perspective view one embodiment of the inventive electrical conduit lock nut having fifteen inset panels as three groups of five alternating around the periphery of the sidewall between the lug panels.

Figure 17:
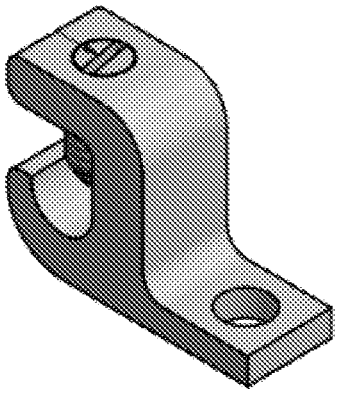
FIG. 17 is a perspective image of lug attachment.

FIG. 17 is a perspective image of lug attachment. FIG. 15 shows attachment tab with locking nut mounting screw hole connected to C-shaped wire attachment clamp having a tightening screw.

Figure 18:
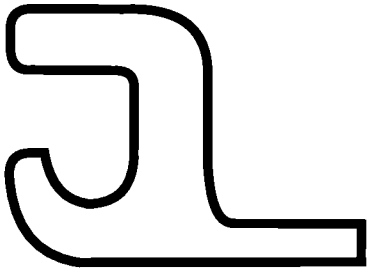
FIG. 18 is a side view of a lug attachment.

FIG. 18 is a side view of a lug attachment.

Figure 19:
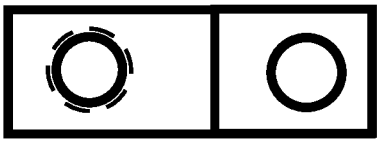
FIG. 19 is a top view of a lug attachment.

FIG. 19 is a top view of a lug attachment.

Figure 20:
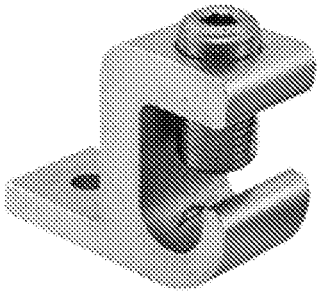
FIG. 20 is a perspective image view of a lug attachment having an alternate screw.

FIG. 20 is a perspective image view of a lug attachment having an alternate screw.

In preferred embodiments, the locking hub nut is manufactured from galvanized steel. In other preferred embodiment, as with other electrical fittings for general purpose use with metal conduits, may be made of die-cast zinc, but where stronger fittings are needed, they are made of copper-free aluminum or cast iron. Alternatively, it may be nickel coated.

The unit is preferably made from a poured mould. Casting methods are well known and include without limitation investment casting, die casting, vacuum casting, and centrifuge casting. Although galvanized steel is preferred for economic reasons, the unit may also be made from any hard conductive metal, alloy, or composite.

Conduit systems are classified by the wall thickness of tubing, mechanical stiffness of the tubing, and material used to make the tubing. Locking hub nut 10 provides a universal solution for many types of conduit including the following.

Example: Rigid Metal Conduit (RMC)

Rigid Metal Conduit (RMC) is a thick threaded tubing, usually made of coated steel, though it may be aluminum. Thicker-walled than IMC.

Example: Rigid Nonmetallic Conduit (RNC)

Rigid Nonmetallic Conduit (RNC) is a non-metallic unthreaded tubing.

Example: Galvanised Rigid Conduit (GRC)

Galvanised rigid conduit (GRC) is galvanised steel tubing, with a tubing wall that is thick enough to allow it to be threaded. Its common applications are in commercial and industrial construction.

Example: Electrical Metallic Tubing (EMT)

Electrical metallic tubing (EMT), sometimes called thin-wall, is commonly used instead of galvanised rigid conduit (GRC), as it is less costly and lighter than GRC. EMT is not threaded. Lengths of conduit are connected to each other and to equipment with clamp-type fittings. Like GRC, EMT is more common in commercial and industrial buildings than in residential applications. EMT is generally made of coated steel, though it may be aluminum.

Example: Electrical Nonmetallic Tubing (ENT)

Electrical Nonmetallic Tubing (ENT) is a thin-walled corrugated tubing that is moisture-resistant and flame retardant. It is pliable such that it can be bent by hand and is often flexible although the fittings are not. It is not threaded due to its corrugated shape although the fittings might be.

Example: Flexible Metallic Conduit (FMC), Armored Cable (Type AC), and Metallic-Clad (Type MC) Cable Flexible Metallic Conduit (FMC) is made through the coiling of a self-interlocked ribbed strip of aluminum or steel, forming a hollow tube through which wires can be pulled. Armored (Type AC) and Metallic-Clad (Type MC) cables are very similar in appearance to FMC. The difference between FMC and AC or MC is that FMC is a conduit and AC/MC are sheathed cable.

Example: Liquidtight Flexible Metal Conduit (LFMC)

Liquidtight Flexible Metal Conduit (LFMC) is a non-metallic and liquidtight jacket covering a flexible metal interior. The interior is similar to FMC.

Example: Flexible Metallic Tubing (FMT)

Flexible Metallic Tubing (FMT) is a liquidtight metallic tubing but unlike LFMC, it lacks a non-metallic jacket.

Liquidtight Flexible Nonmetallic Conduit (LNFC)

Liquidtight Flexible Nonmetallic Conduit (LNFC) refers to several types of flame-resistant non-metallic tubing. Interior surfaces may be smooth or corrugated. There may or may not be integral reinforcement within the conduit wall. It is also known as FNMC.

Aluminum Conduit

Aluminum conduit, similar to Galvanized Metal Conduit (GMC), is a rigid conduit, generally used in commercial and industrial applications, where a higher resistance to corrosion is needed.

Intermediate Metal Conduit (IMC)

Intermediate Metal Conduit (IMC) is a steel tubing heavier than EMT but lighter than RMC. It may be threaded.

PVC Conduit

PVC conduit is the lightest in weight compared to other conduit materials, and usually lower in cost than other forms of conduit. In North American electrical practice, it is available in three different wall thicknesses, with the thin-wall variety only suitable for embedded use in concrete, and heavier grades suitable for direct burial and exposed work. The various fittings made for metal conduit are also made for PVC. The plastic material resists moisture and many corrosive substances, but since the tubing is non-conductive an extra bonding (grounding) conductor must be pulled into each conduit.

Having thus described several illustrative embodiments, it is to be appreciated that various alterations, modifications, and improvements will readily occur to those skilled in the art. Such alterations, modifications, and improvements are intended to be part of this disclosure, and are intended to be within the spirit and scope of this disclosure. While some examples presented herein involve specific combinations of functions or structural elements, it should be understood that those functions and elements may be combined in other ways according to the present invention to accomplish the same or different objectives. In particular, acts, elements, and features discussed in connection with one embodiment are not intended to be excluded from similar or other roles in other embodiments. Accordingly, the foregoing description and attached drawings are by way of example only, and are not intended to be limiting.

It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

I claim:

1. A smooth-bore conduit bushing for terminating an electrical conduit having a protective rounded rim to avoid wire insulation damage, comprising: a conduit bushing having a smooth non-threaded inner surface along a central axial bore extending through the conduit bushing, wherein said conduit bushing is toroid-shaped and has a rounded end and a flat end, said conduit bushing having an external sidewall having a plurality of inset panels alternating with a plurality of lug panels, each said inset panel configured as an inverted parabolic inset panel defining a series of columnar supports around a periphery of the external sidewall of the conduit bushing, said inverted parabolic inset panel having an open portion toward the rounded end of the conduit bushing and said inverted parabolic inset panel having a rounded portion toward the flat end of the conduit bushing, each said lug panel having a low-profile and raised above the external sidewall about the same distance that each said parabolic inset panel is recessed below the external sidewall, said columnar supports configured to provide engagement using a common pliers and not require a special tightening tool, wherein the rounded end has a rounded rim, said rounded rim having a substantially smooth surface and extending inwardly into the central axial bore, wherein upon threading wiring through the central axial bore the rounded rim guides the wiring travelling therethrough in such a manner that there is minimal interaction with any sharp edges while being pulled through a length of conduit and interacting with the conduit bushing during such a pull operation, and wherein the conduit bushing has a height from flat end to rounded end of from about 11 mm to about 16 mm and provides for engagement with a junction box without using a lock nut.

2. The smooth-bore conduit bushing of claim 1, further comprising wherein flat end has gripping projections that allow the conduit bushing to engage with the junction box and increase the frictional interaction to substantially prevent unwanted rotation.

3. The smooth-bore conduit bushing of claim 1, further comprising wherein the conduit bushing has a central axial bore that is sized to engage with conduit of a specific diameters, said conduit diameter selected from a group of standard conduit sizes comprising ½", ¾", 1", 1¼", 1½", 2", 2½", 3", 3½", 4", 5", and 6".

4. The smooth-bore conduit bushing of claim 1, wherein the conduit bushing has a central axial bore sized to engage conduit of a diameter comprising ½", ¾", or 1".

5. The smooth-bore conduit bushing of claim 1, further comprising wherein the conduit bushing is manufactured from galvanized steel or die-cast zinc.

6. The smooth-bore conduit bushing of claim 1, further comprising wherein each said lug panel includes a screw lug to engage conduit with a setscrew inserted into a through-hole of said screw lug.

7. The smooth-bore conduit bushing of claim 6, further comprising wherein the flat end has gripping projections that allow the conduit bushing to engage with the junction box and increase the frictional interaction to substantially prevent unwanted rotation.

* * * * *